US005105737A

United States Patent [19]

Becker

[11] Patent Number: 5,105,737

[45] Date of Patent: Apr. 21, 1992

[54] SHEET-GUIDING DRUM FOR A PRINTING MACHINE CONVERTIBLE FROM FIRST FORM TO PERFECTOR PRINTING

[75] Inventor: Willi Becker, Bammental, Fed. Rep. of Germany

[73] Assignee: Heidelberger Druckmaschinen AG, Heidelberg, Fed. Rep. of Germany

[21] Appl. No.: 465,906

[22] Filed: Jan. 16, 1990

[30] Foreign Application Priority Data

Jan. 13, 1989 [DE] Fed. Rep. of Germany ..... 3900818

[51] Int. Cl.[5] ..... B41F 5/04

[52] U.S. Cl. ..... 101/230; 101/246

[58] Field of Search ..... 101/230, 174, 231, 232, 101/409, 410, 229, 222, 223, 246; 192/70.23

[56] References Cited

U.S. PATENT DOCUMENTS

| | | | |
|---|---|---|---|
| 4,457,231 | 7/1984 | Kawaguchi | 101/230 |
| 4,513,633 | 4/1985 | Goscenski, Jr. | 192/70.23 |
| 4,563,951 | 1/1986 | Mathes et al. . | |
| 4,580,494 | 4/1986 | Becker | 101/230 |
| 4,716,827 | 1/1988 | Wieland et al. | 101/230 |
| 4,735,140 | 4/1988 | Wieland et al. | 101/230 |
| 4,831,929 | 5/1989 | Saito | 101/230 |

FOREIGN PATENT DOCUMENTS

| | | | |
|---|---|---|---|
| 0005715 | 12/1979 | European Pat. Off. | 101/230 |
| 0216045 | 7/1986 | European Pat. Off. | 101/230 |
| 0216046 | 7/1986 | European Pat. Off. | 101/230 |
| 2708478 | 8/1978 | Fed. Rep. of Germany . | |
| 3611325 | 8/1987 | Fed. Rep. of Germany | 101/230 |
| 0170278 | 4/1983 | Japan | 101/230 |
| 62248643 | 10/1987 | Japan . | |
| 2142908 | 1/1985 | United Kingdom | 101/230 |

*Primary Examiner*—Edgard S. Burr
*Assistant Examiner*—John S. Hilten
*Attorney, Agent, or Firm*—Herbert L. Lerner; Laurence A. Greenberg

[57] ABSTRACT

Sheet-guiding drum for a printing machine convertible from first form to perfector printing and in reverse, including at least two sheet-guiding surfaces formed at a circumference of segments of an outer drum part which are adjustable in circumferential direction with respect to an axial support member for journalling the sheet-guiding drum, and a clamping device for locking together the segments of the outer drum part and the journalling axial support member, the clamping device having radially directed friction surfaces disposed on the segments of the outer drum part and on the journalling axial support member and being pressable with a clamping force against one another in axial direction, and a tension rod movable in axial direction of the journalling axial support member for pressing the friction surfaces on the segments and on the journalling member against one another, includes lamellar, interengaging friction elements alternately connected to one of the segments of the outer drum part and to the journalling axial support member so as to be fixed against rotation relative thereto, said friction elements being disposed between two counter bearings supported on the journalling axial support member, and a movable clamping lever in the form of a rocker arm disposed transversely to the axial direction of the clamping force, said clamping lever having an end thereof spring-loaded in the axial direction of the clamping force via the tension rod, the rod being secured against rotation.

15 Claims, 4 Drawing Sheets

SHEET-GUIDING DRUM FOR A PRINTING MACHINE CONVERTIBLE FROM FIRST FORM TO PERFECTOR PRINTING

The invention relate to a sheet-guiding drum for a printing machine convertible from first form to perfector printing and in reverse and, more particularly, to such a sheet-guiding drum including at least two sheet-guiding surfaces formed at a circumference of segments of an outer drum part which are adjustable in circumferential direction with respect to an axial support member for journaling the sheet-guiding drum, and a clamping device for locking together the segments of the outer drum part and the journaling axial support member, the clamping device having radially directed friction surfaces disposed on the segments of the outer drum part and on the journaling axial support member and being pressable with a clamping force against one another in axial direction, and a tension rod movable in axial direction of the journaling axial support member for pressing the friction surfaces on the segments and on the journaling member against one another.

A sheet-guiding drum of this general type has become known heretofore from Japanese Patent (Sho) 62-248643, wherein a sheet-guiding drum is provided as a storage drum forward of a turning drum for turning the rear edge of a sheet. The sheet-guiding drum of this Japanese patent has segments on the outer circumference thereof which form outer drum parts, and are equipped with suction devices for guiding and smoothing the sheet adjacent to the sheet-guiding surface. The position of the suction devices relative to gripping devices for transport of the sheet must be adjusted to the format of the sheet to be printed. This adjustment is effected independently of the adjustment of the gripping devices from first form to perfector printing and should be simple to perform, yet requires great prevision. For this purpose, the segments which form the actual drum are supported on an internal shaft, are adjustable with respect to this shaft in circumferential direction, and can be locked together with this shaft in the adjusted position by means of a clamping device wherein the segments forming the two ends of the outer drum parts have radially inwardly directed side parts braced against one another by means of a tension rod, which is disposed in a channel extending centrally through the inner shaft and acts outwardly against the side parts via clamping shoes which are disposed in a respective recess which extends transversely through the shaft. The tension rod has a head end by which it engages one of the clamping shoes from behind, and has another end formed with a thread which can be screwed into an inner thread at the end of the channel in the shaft, this other end being braced against the outside of the other clamping shoe by means of a sleeve which surrounds the tension rod and by a package of springs, so that tension rod can be turned by means of an externally located actuating element, and spring tension can thus be created for reciprocally bracing the side parts of the segments, thereby producing a firm connection with the shaft via the clamping shoes. The bracing of the side parts readily leads to warping of the segments and the suction device mounted therewithin, so that the sheet-guiding surfaces of the segments and the suction device assume a curvature or bulge which adversely affects the perfected printing. Furthermore, the accommodation of the parts of the clamping device in the central channel and in the continuous recesses extending transversely thereto, leads to a reduction in the stability of the sheet-guiding drum. In this regard, the clamping forces correspond directly to the spring tension in the package of springs, which must have a suitably strong construction, so that large operating forces can be applied to the actuating element. In the foregoing, heretofore known arrangement, the gear wheel provided for driving the sheet-guiding drum is screwed together with the parts of the clamping device onto the front end face of the shaft, so that it is necessary to disassemble the clamping device in order to change this gear wheel. The clamping device is very costly and does not offer any means for ensuring the clamping when the machine is running.

Sheet-guiding drums have also become known heretofore which has a solid drum body with an integrally-cast journal for bearing the drum, instead of using an inner shaft.

A clamping device for the same general purpose has become known heretofore from German Published Non-Prosecuted Application (DE-OS) 34 10 689, which describes an inner shaft of hollow construction for a storage drum and a one-piece second hollow shaft disposed within the first-mentioned shaft so as to be rotatable therein, the second shaft having clamping cam formations on the circumference thereof, which cooperate with clamping members which are supported between the clamping cams and the segments forming the actual drum, for example carrying elements for the suction device. Within the second hollow shaft is a third shaft provided as an adjusting shaft, one end of which is connected to an actuating element, and the other end of which carries a gear wheel for a pivot drive of a sheet smoothing device. Three clamping members are distributed uniformly around the circumference, are disposed in recesses formed in the first-mentioned shaft of hollow construction, and are pressable with a suitably adapted contour against the inner circumference of an expansion sleeve slotted in longitudinal direction, and thereby radially outwardly from the inside against the support members, for which purpose the second hollow shaft is rotated with respect to the first-mentioned shaft, so that the rollers on the clamping members cause the latter to ride onto the cams located on the circumference of the second hollow shaft. The stability of the sheet-guiding drum is reduced considerably by the hollow shaft construction. The bracing forces of the clamping device act radially outwardly, so that the segments of the outer drum are expanded or spread out, the components of the smoothing device accommodated therein being shifted outwardly in the central region of the drum, so that doubling effects appear in the perfector printing. The clamping forces are dependent upon the operating forces, so that large clamping forces also require large operating forces. The foregoing heretofore-known construction is also very costly, difficult to assemble and without any electrical circuit-breaking protection.

The axially displaceable mounting of a rod in a hollow shaft has furthermore become known heretofore from German Published Non-Prosecuted Application (DE-OS) 27 08 478, and serves for converting a turning drum from first form to perfector printing.

It is accordingly an object of the invention to provide a sheet-guiding drum of the foregoing general type, with a clamping device formed of as few and as simple components as possible, which is effective by means of large friction forces independent of the operating forces without distortion of the surfaces guiding the sheet, and if desirable or necessary, without elements for carrying the smoothing devices, and wherein the components can be accommodated without any significant weakening of the inner shaft having the journals.

With the foregoing and other objects in view, there is provided, in accordance with the invention, a sheet-guiding drum for a printing machine convertible from first form to perfector printing and in reverse, including at least two sheet-guiding surfaces formed at a circumference of segments of an outer drum part which are adjustable in circumferential direction with respect to an axial support member for journaling the sheet-guiding drum, and a clamping device for locking together the segments of the outer drum part and the journaling axial support member, the clamping device having radially directed friction surfaces disposed on the segments of the outer drum part and on the journaling axial support member and being pressable with a clamping force against one another in axial direction, and a tension rod movable in axial direction of the journaling axial support member for pressing the friction surfaces on the segments and on the journaling member against one another, comprising lamellar, interengaging friction elements alternately connected to one of the segments of the outer drum part and to the journaling axial support member so as to be fixed against rotation relative thereto, the friction elements being disposed between two counter bearings supported on the journaling axial support member, and a movable clamping lever in the form of a rocker arm disposed transversely to the axial direction of the clamping force, the clamping lever having an end thereof spring-loaded in the axial direction of the clamping force via the tension rod, the rod being secured against rotation.

In accordance with another feature of the invention, the journaling axial support member is a drum journal cast integrally with a drum body of the sheet-guiding drum.

In accordance with a further feature of the invention, the journaling axial support member is an internal shaft extending through a drum body of the sheet-guiding drum.

In accordance with an added feature of the invention, the clamping lever is disposed in a lateral recess formed in the shaft, and the tension rod is disposed in a bore formed in the shaft and extends from an end face of the shaft in axial direction of the shaft to the lateral recess.

In accordance with an additional feature of the invention, the friction elements alternately connected to the segments and to the shaft have a mutually overlapping region, and the clamping lever is loosely disposed in the lateral recess and, in the mutually overlapping region, is active, by means of a radially outwardly directed end thereof, against an inner side of a flange extending radially inwardly on the segment, the clamping lever being pivotable about a counter-bearing disposed in a defining wall of the lateral recess on a side thereof located opposite from the friction surfaces of the friction elements, the counter-bearing being located at a shorter radial distance from the outwardly directed end of the clamping lever than from the other end thereof.

In accordance with again another feature of the invention, respective supporting surfaces for the clamping lever are formed on inserts of hardened material.

In accordance with again a further feature of the invention, a plurality of the friction elements and relatively thinner intermediate layers are secured to an end face of the segment extending radially to the axis of the shaft, on the one hand, and a plurality of the friction elements complementary thereto are secured to a surface of the shaft extending radially to the shaft axis, on the other hand, the mutually overlapping region of the interengaging friction elements being disposed in a force flux of the two counter-bearings for the clamping force.

In accordance with again an added feature of the invention, there is included an actuating member disposed at the end face of the shaft and engageable with the tension rod for retracting the tension rod against the action of a spring biasing the tension rod in the clamping direction, and an electrical circuit-breaking protection device couplable with the tension rod so as to displace the tension rod in axial direction only after traversing an axially effective idle path, for the purpose of tripping the protection device.

In accordance with again an additional feature of the invention, a substantially bell-shaped housing is secured to the end face of the shaft, the spring biasing the tension rod in the clamping direction being braced, on the one hand, against the housing and, on the other hand, against the tension rod, the tension rod having a free end formed with a thread and extending axially displaceably outwardly through the housing, the actuating member being formed with an internal thread corresponding to the thread formed on the free end of the tension rod and being screwable thereon for axially displacing the tension rod through a first phase corresponding to the idle path, and through a second subsequent phase wherein the actuating member is braced against the housing.

In accordance with yet another feature of the invention, stops for limiting end positions of the displacement of the actuating member and for simultaneously defining the idle path for tripping the electrical circuit-breaking protection device are provided, one of the stops limiting turning of the actuating member being movable by the tension rod, at the end of the axial displacement thereof, when the clamping device is released into operative position thereof.

In accordance with yet a further feature of the invention, the stops are active in radial direction and have a mutual axial overlap in the stop positions thereof which is smaller than the pitch of the thread with which the actuating member is screwed onto the tension rod.

In accordance with yet an added feature of the invention, the stops are formed by a cam on the actuating member, and two of the cams are fixed against rotation and spaced from one another in the displacement direction of the tension rod a distance corresponding to the length of the idle path, the two cams fixed against rotation being axially displaceable.

In accordance with yet an additional feature of the invention, the two axially displaceable cams are secured to an outer end of a bolt extending through the substantially bell-shaped housing, the bolt having an inner end braced axially against the tension rod under biasing action of a spring.

In accordance with still another feature of the invention, there is included a structural unit preassemblable in the clamping device and comprising the substantially bell-shaped housing and the tension rod spring-biased in the clamping direction disposed in the housing, the actuating member and the stops associated therewith, and switching members for the electrical circuit-breaking protection device; and screw means for securing the structural unit to the end surface of the shaft.

In accordance with a concomitant feature of the invention, the actuating member comprises a nut manually screwable on the thread of the tension rod.

In a clamping device of the foregoing type, only one side cheek, or one other somewhat radially extending component of the adjustable drum part is clamped, so neither axial nor radial deformation can occur. The arrangement of several friction members, which engage with one another alternately as lamellar, results in a considerable increase in the friction forces for given clamping forces, and thereby in a correspondingly reliable connection of the parts in frictional contact. This permits the introduction of clamping forces independently of the operating forces, by means of a package of relatively weakly designed springs having a spring tension which is transmitted by means of the clamping lever supported as a rocker arm or tilt lever, with corresponding lever transmission to one of the two counterbearings which clamps the overlap region of the mutually engaging friction members therebetween.

Due to this lever transmission in connection with the increase in the friction surfaces, the operating forces are further reduced, so that a package of springs coordinated therewith can easily be compressed by means of an actuating member which is manually screwable on the tension rod, in order to release the clamping. The very easy manual actuation thus represents a particular advantage of the features of the invention.

Accordingly, the tension rod for the transmission of the spring force of the package of springs which initiate the clamping forces can also be of relatively thin construction, so that it can be accommodated in a bore of relatively small cross section, and the shaft and the journal of the shaft, respectively, are not noticeably weakened thereby. Also, the accommodation of the clamping lever, which is preferably manufactured from an extremely rigid material, in a lateral recess of the shaft and of the integrally-cast journal, respectively, does not lead to any significant weakening of this shaft and of the journal, respectively, because the recess can be kept relatively small in cross section and, furthermore, does not have to be of continuous construction.

The end of the tension rod which protrudes from the front end face of the shaft and the journal, respectively, and the springs which initiate the clamping forces, are disposed in a substantially bell-shaped housing, the springs being braced, on the one hand, against this bell-shaped housing and, on the other hand, against an enlargement of the tension rod, for example against a flange of the tension rod. The free end of the tension rod extends axially displaceably through the bell-shaped housing, and is formed with a thread, on which a corresponding inner thread of an actuating member can be screwed, in a first phase which corresponds to an idle path and in a second phase wherein the actuating member lies against the bell-shaped housing and, when screwed further against the action of the springs, axially displaces the tension rod. The idle path of the actuating element can be used, in a conventional manner, for actuating the switching members of an electrical circuit-breaking protection device. It thereby becomes possible to provide an electrical circuit-breaking protection device on sheet-guiding drums of the foregoing type for closed clamping when the machine is in an operating mode.

It is also advantageous to provide for an axial overlap region of the radially active stops in the stop positions which is smaller than the pitch of the thread by which the actuating member is movable on the tension rod. By means of such a construction, the idle path of the actuating member cam be made to correspond to several revolutions.

In connection with the provision of the preassemblable structural unit, it is particularly worthy of mention that the means for actuating the clamping device and the means for protecting the clamping device with an electrical circuit breaker are positioned separately from the drive gear wheel, and thus cannot be a hindrance when, for example, the drive gear wheel has to be assembled, disassembled or adjusted.

When a sheet-guiding drum with a clamping device has the aforementioned construction with friction members and actuation thereof via a rocker arm, and an initiation of clamping forces independently of the operating forces by means of a package of springs, it is adequate for these features to be arranged on one side. If desirable or necessary, however, such an arrangement can also be made on both sides, with mutually independently functioning means.

Other features which are considered as characteristic for the invention are set forth in the appended claims.

Although the invention is illustrated and described herein as embodied in a sheet-guiding drum for a printing machine convertible from first form to perfector printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
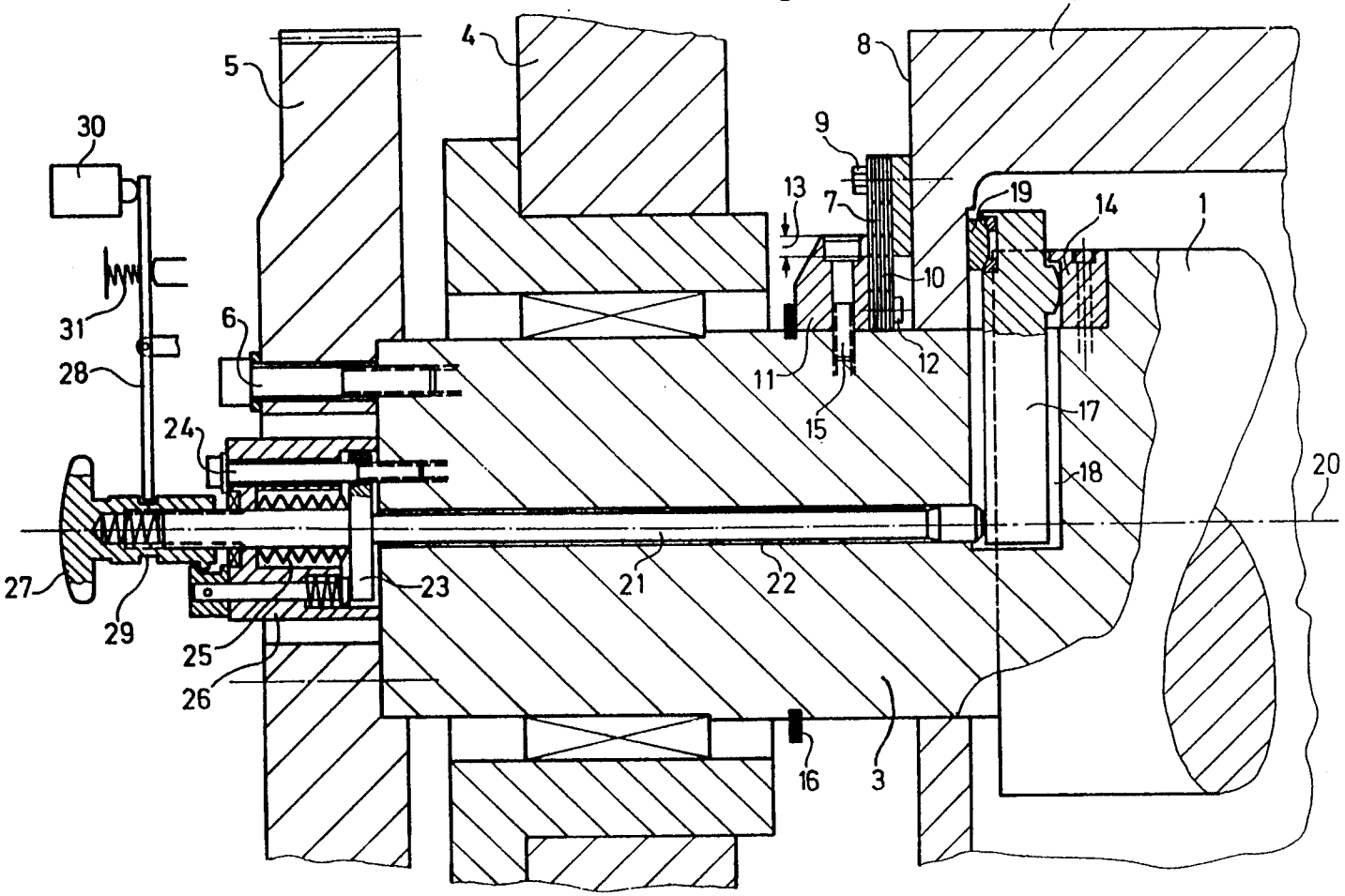
FIG. 1 is an axial sectional view of an end of a sheet guiding drum and its bearing, and the electrical circuit-breaking device for protecting a clamping device thereof, in accordance with the invention.

Referring now to the drawing and first, particularly, to FIG. 1 thereof, there is shown therein a sheet guiding drum with an internal shaft 1 of solid material and an external drum body with at least one segment which is adjustable with respect to the internal shaft 1 in circumferential direction thereof. Instead of the illustrated embodiment with a continuous internal shaft, a construction with a drum body, and a pin or journal integrally cast thereon for the bearing of the drum can also be provided, so that the construction described hereinafter can be disposed in such a pin or journal.

Figure 2:
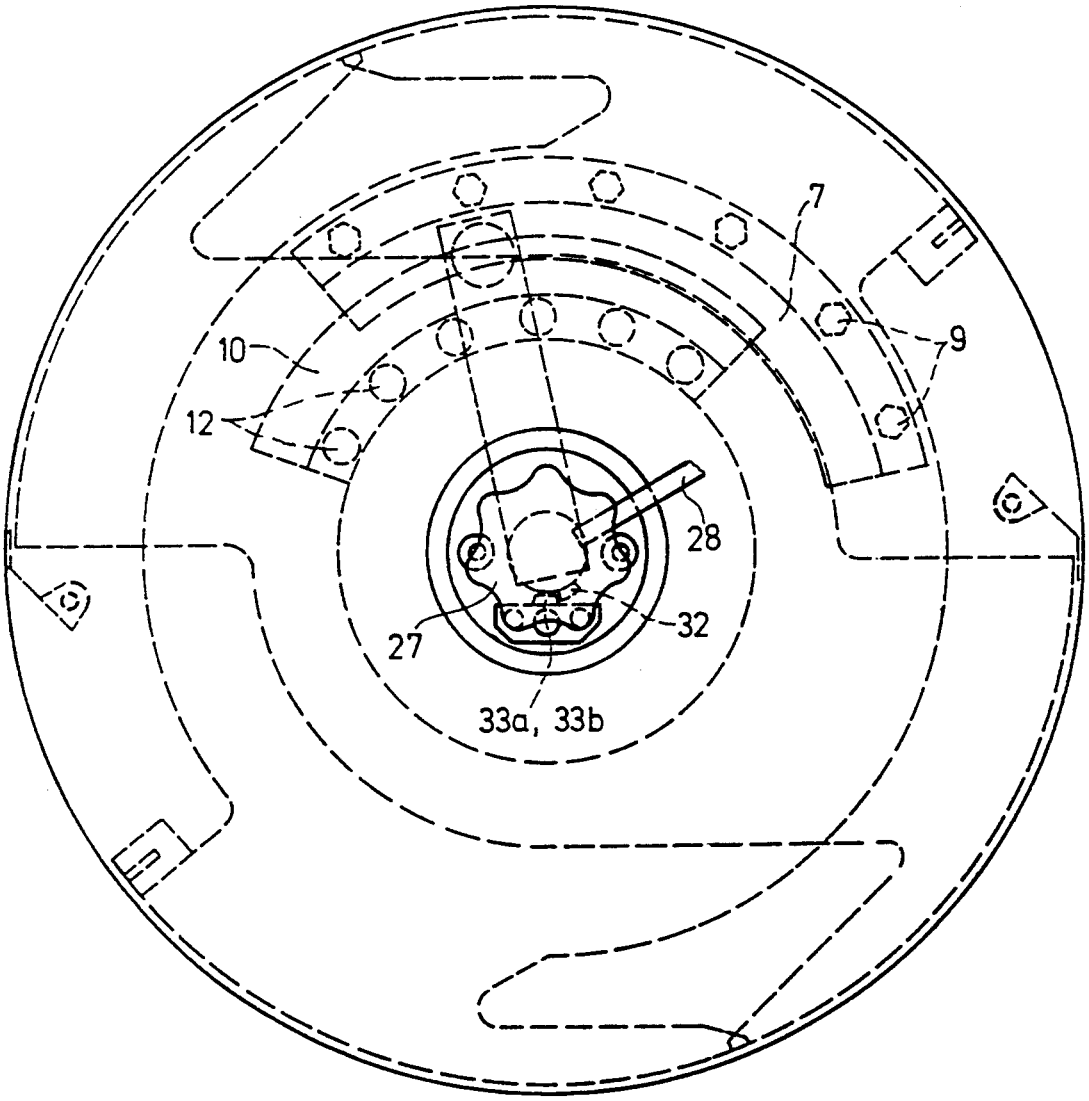
FIG. 2 is a side elevational view of FIG. 1.

A sheet feeding surface is formed on the outer cylindrical surface of the segment 2. In addition, suction nozzles or other sheet smoothing and gripping devices, respectively, may be provided. The segment 2 can be firmly locked with the internal shaft 1 by means of a clamping device. The internal shaft 1 is supported at both ends thereof in lateral walls 4 of the machine frame by means of journals 3 which are formed of solid material and are integral with the shaft 1. The internal shaft 1 is drivable by a gear wheel 5, which is connected, outside the machine frame, to an end face of the shaft 1 by means of several screws 6 located at variously distributed positions. To provide a reliable, frictionally secured interlocking of the shaft 1 and the segments 2 disposed in the external drum, several friction members 7, like in a type of disk clutch, are fixed as a package (for example by means of screws 9) at a spaced distance from one another, to a surface 8 of the segment 2, the surface 8 extending radially and as close as possible to the lateral wall 4. A complementary formed package of friction members 10 is also fixed (for example by means of screws 12) to a likewise radially extending surface, of a counter-bearing 11, which is connected, however, to the journal 3 or directly to the shaft 1, the friction members 7 having intermediate laminations of equal thickness, and the friction members 10 which are also formed of such intermediate laminations meshing together and overlapping within a given region 13. In this overlap region 13, the friction members 7 fixed to the segment 2, and the friction members 10 fixed to the counter-bearing 11 can be axially braced against one another between the counter-bearing 11 and a second counter-bearing 14 on the shaft 1, so that high frictional forces are created due to the increase in the friction surfaces between the friction members 7 and 10, even though the clamping force for bracing is relatively small. In the illustrated embodiment of FIG. 1, three friction members, respectively, are in one package so that seven friction surfaces exist in the overlap region 13. In order to match the friction members 7 and 10 to the shape of the segment 2, the friction members 7 and 10 are also segment-shaped so that, from a side view, they only extend over a part of the circumference, as can be seen from FIG. 2. In the illustrated embodiment of FIG. 1, the counter-bearing 11 is formed by a ring segment, which is fastened by means of screws 15 to the journal 3 of the shaft 1 and, in addition, is braced axially against a support ring 16 or the like.

The clamping device has a clamping lever 17, which is disposed in a lateral recess 18 formed in the shaft 1, and is effective therein as a rocker with lever arms of unequal length. The clamping lever 17 is braced, in the vicinity of a radially outer end thereof against the counter-bearing 14 and, by means of a pressure block 19, exerts pressure in the overlap region 13 against the inner side of the radial part of the segment 2 which is located opposite to the surface 8, so that the pressure forces act parallel to the longitudinal axis 20 of the shaft 1. A surface at an end of a tension rod 21, which is permanently spring-loaded in the direction of clamping, presses the other end of the clamping lever 17 in the direction of the shaft axis 20. The tension rod 21 is disposed centrally or eccentrically in a recess or bore 22 formed in the journal 3 and extending parallel to the shaft axis 20, the other end of the tension rod 21 protruding from the face of the journal 3 of the shaft 1. Outside the journal 3, the tension rod 21 is formed with an annular flange 23, which is penetrated by a screw 24 in at least one location thereof for securing the tension rod 21 against torsion without impeding any axial displacement thereof.

A spring set or package 25, for example of cup or plate springs, is disposed outside the annular flange 23 and is braced, at one side thereof, against the annular flange 23 and at the other side thereof, against the inner side of a substantially bell-shaped housing 26, which is firmly fastened to the end face of the journal 3 by the screw 24 and other non-illustrated screws. For this purpose, the gear wheel 5 is formed with a central recess which permits the bell-shaped housing 26 to extend therethrough. The tension rod 21 is constantly pressed against the radially inner end of the clamping lever 17 by the spring package 25, so that the resilient forces are multiplied by means of this clamping lever 17, and are transmitted to the friction surfaces of the friction members 7 and 10. As a result, the clamping force between the friction members 7 and 10 is exclusively dependent upon the elastic force of the spring 15, and not on auxiliary forces. The free end of the tension rod 21 protrudes through the base of the bell-like housing 26 to the outside, and connected there to an actuating member 27. In the illustrated embodiment, a thread is provided on the outer end of the tension rod 21, and an inner thread of the actuating member 27 is screwable thereon; the resulting assembly cooperates with an electrical circuit-breaking mechanism for protecting the clamping device. For this purpose, the actuating member 27, starting from the clamping position, is screwed onto the thread of the tension rod 21, initially along an idle path which is set for actuating the electrical circuit-breaking protection mechanism. By way of example, a switching element 28 is shown, which is in the form of a rocker arm firmly mounted on the machine, one end of the rocking arm 28 engaging in a circumferential recess 29 formed on the actuating member 27, while the other end of the rocking arm 28 acts against an electrical switch 30, a spring 31 being provided which exerts pressure on the switching element 28 in the direction of the starting position thereof prior and opposite to its movement towards the switch 30. Only after passing through the idle path, does the actuating member 27 come to rest against an axial roller bearing 36 (FIG. 4) at the outside of the bell-shaped housing 26, so that, as the actuating member 27 continues to be screwed on, the tension rod 21 is axially shifted towards the left-hand side in the projection plane of FIG. 1. The pressure on the clamping lever 17 is thereby relieved, so that the frictionally locked connection between the friction members 7 and 10 is released. When the actuating member 27 is turned in the opposite direction, the spring set 25 initially presses the tension rod 21 against the inner end of the clamping lever 17 with the force of the spring set 25, so that the frictionally locked connection between the friction members 7 and 10 is restored, before the actuating member 27 can be turned back to the starting position on the idle path, whereby it again releases the switch 30 for providing the electrical circuit-breaking protection of the clamping device, via the switching element 28.

Figure 3:
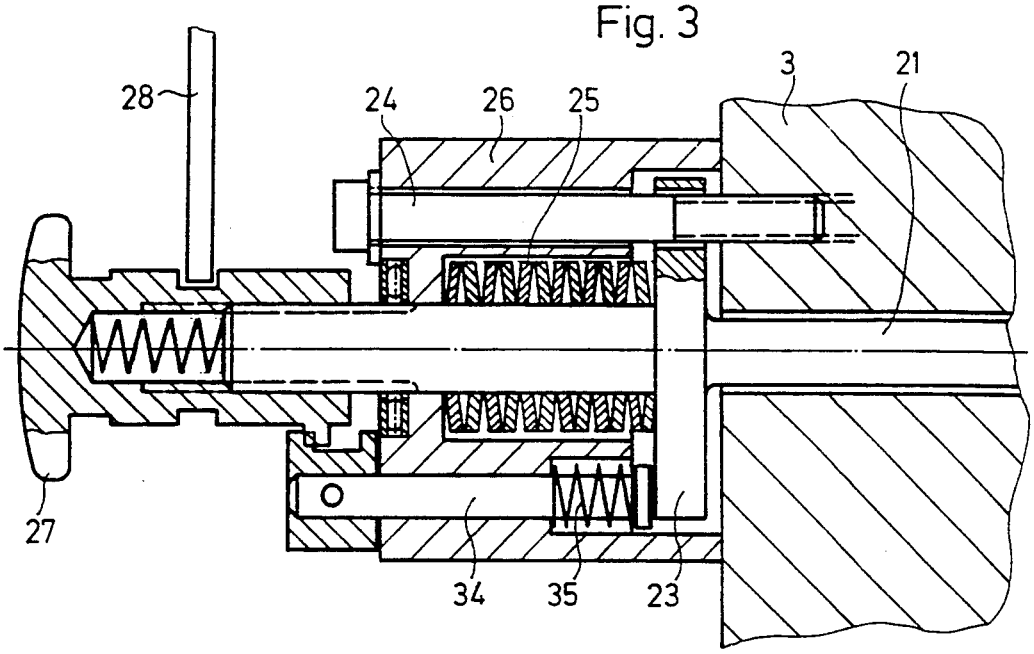
FIG. 3 is an enlarged fragmentary view of FIG. 1, showing the operating mechanism of the circuit-breaking device, with the clamping device in closed position.
Figure 4:
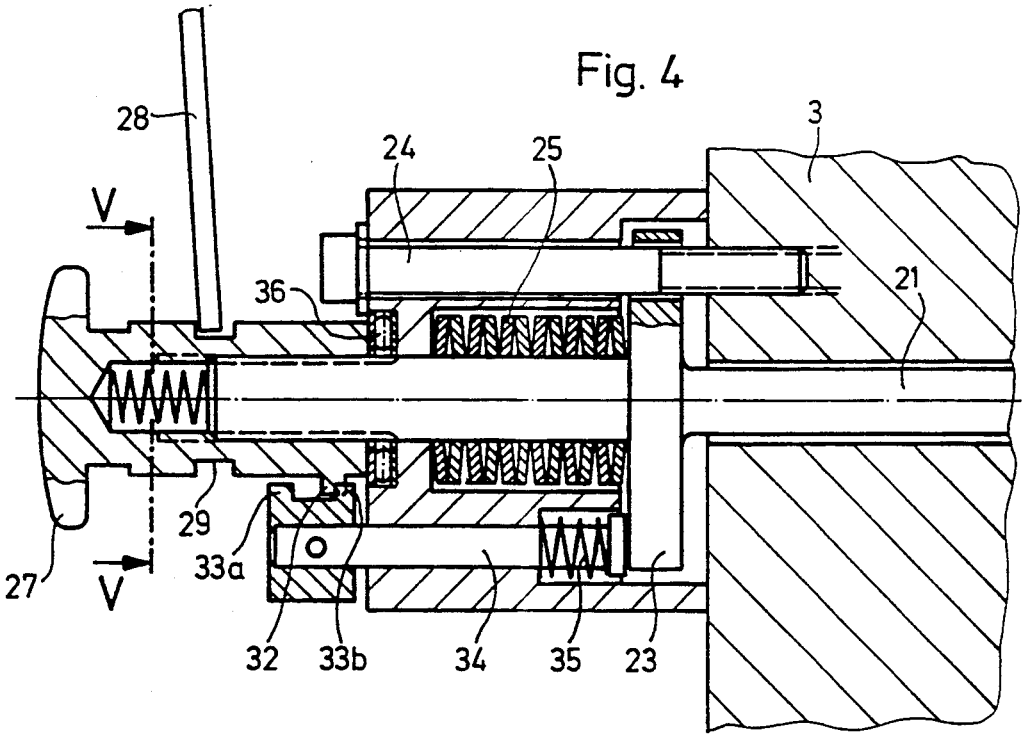
FIG. 4 is a view similar to that of FIG. 3, showing the operating mechanism in another operating phase thereof, the clamping device being in open position.
Figure 5:
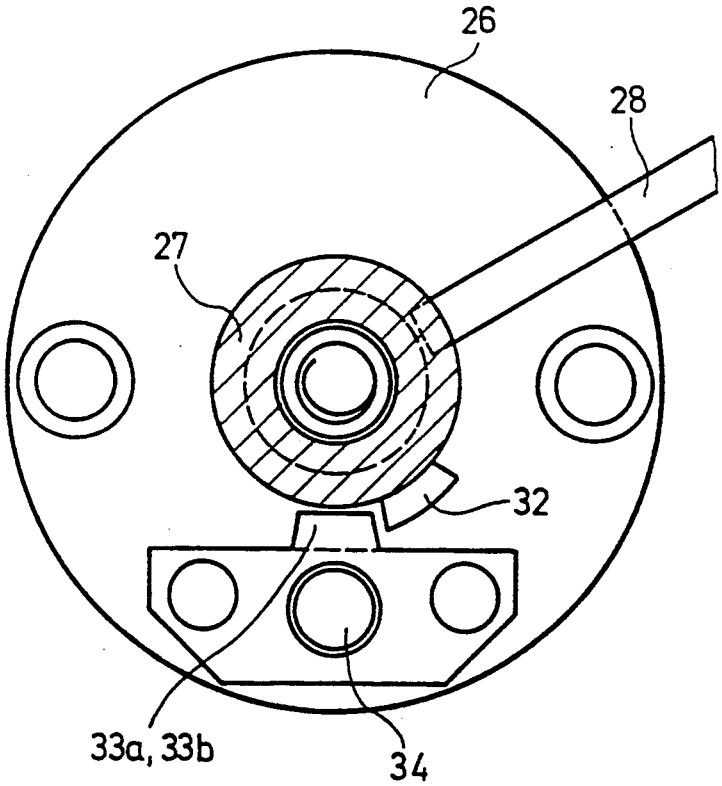
FIG. 5 is a cross-sectional view of FIG. 4 taken along the line V—V in the direction of the arrows.

In accordance with an independent inventive concept, the end positions for the movement of the actuating member 27 are limited by respective stops 32 and 33*a* and 33*b* (FIGS. 2 and 4) which are constructed so that they also define the idle path for switching the electrical circuit-breaking protection mechanism. For this purpose, provision is made that, at the end of the axial movement of the tension rod 21, the latter moves the stop 33*b*, which limits the turning movement when the clamping device is released, so that the stop 33*b* is in its active position. Furthermore, the axial overlap of the radially operating stop 32 with the stops 33*a* and 33*b*, respectively, in the stop positions is smaller than the pitch of the thread on the free end of the tension rod 21 and in the actuating member 27, respectively. Provision is made for one stop 32 to be formed of a cam on the actuating member 27, this cam stop 32 having two stop surfaces, one of which, respectively, is active in each direction of revolution; and provision is also made for counter-stops 33*a* and 33*b* on machine parts which are fixed against rotation, the counter-stops 33*a* and 33*b* being positioned in the axial direction of the tension rod 21 and the shaft 1, respectively, at a spaced distance from one another which corresponds to the length of the idle path, the counterstops 33*a* and 33*b* being axially displaceable on an outer end of a bolt 34 which is axially movable in the substantially bell-shaped housing 26, and has an inner end which is braced against the annular flange 23 of the tension rod 21. Due to the fact that the overlap between the stop 32 and the stops 33*a* and 33*b*, respectively, is smaller than the thread pitch and, due to the axial spacing between the two latter stops 33*a* and 33*b*, the stop 32 on the actuating member 27 can perform several revolutions of the actuating member 27 in order to provide an idle path of sufficient length for actuating the electrical circuit-breaking protection mechanism, and the stop 32 may be turned further in order to enable an axial displacement of the tension rod 21 against the action of the spring set 25 so as to release the clamping device, before the stop 32 comes to rest against the stop 33*b* in the end position when the clamping device is released. For this purpose, the stop 33*b* is subjected to a slight axial displacement by the bolt 34, starting from the axial movement of the tension rod 21, so that the stop 33*b* engages in or intersects the turning circle of the stop 32. During the first revolution of the actuating member 27 in the opposite direction, the tension rod 21 moves to the right-hand side, as viewed in FIG. 1, for example, so that the stop 33*b*, reinforced or supported by the spring 35, also moves to the right-hand side, so as to rest against the substantially bell-shaped housing 26, and is no longer in the way of or blocks the stop 32 during the next revolution of the actuating member 27. Only after the idle path has been traversed, does the stop 32 again come to rest against the stop 33*a*, as shown in FIG. 3, so that the other end position of the actuating member 27 is thereby delimited. As is readily apparent, FIG. 4 shows the contact between the stops 32 and 33*b* when the clamping device is released.

Instead of the manually turnable actuating member 27, as described hereinbefore, a motorized actuating member for the tension rod 21 can be provided.

The foregoing is a description corresponding in substance to German Application P 39 00 818.5, dated Jan. 13, 1989, the International priority of which is being claimed for the instant application, and which is hereby made part of this application. Any material discrepancies between the foregoing specification and the aforementioned corresponding German application are to be resolved in favor of the latter.

I claim:

1. Sheet-guiding drum for a printing machine convertible from first form to perfector printing and from perfector to first form printing, comprising an axial support member for journalling the sheet-guiding drum, the sheet-guiding drum having an outer drum part formed of segments defining a circumference and adjustable in circumferential direction with respect to said axial support member, at least two sheet-guiding surfaces formed at said circumference, and a clamping device for locking together said segments of said outer drum part and said journalling axial support member, said clamping device having radially directed friction surfaces disposed on said segments of said outer drum part and on said journalling axial support member at a location thereof eccentric to a longitudinal axis of said support member and being pressable with a clamping force one against the other in axial direction, said journalling axial support member being formed with a bore, and a tension rod disposed in said bore, said tension rod being secured against rotation and being movable in axial direction of said journalling axial support member for pressing said friction surfaces on said segments and on said journalling member one against the other, lamellar, interengaging friction elements alternately connected to one of said segments of said outer drum part and to said journalling axial support member so as to be fixed against rotation relative thereto, two counter bearings supported on said journalling axial support member, said friction elements being disposed between said two counter bearings and a single movable clamping lever in the form of a rocker arm disposed transversely to said axial direction of said clamping force, said clamping lever having one end thereof spring-loaded in said axial direction of said clamping force through the intermediary of said tension rod, and another end thereof substantially in axial alignment with said eccentric location of said friction surfaces.

2. Sheet-guiding drum according to claim 1, comprising a drum body, said journalling axial support member being a drum journal cost integrally with said drum body of the sheet-guiding drum.

3. Sheet-guiding drum according to claim 1, comprising a drum body, said journalling axial support member being an internal shaft extending through said drum body of the sheet-guiding drum.

4. Sheet-guiding drum according to claim 3, wherein said shaft is formed with a lateral recess, and a bore extending from an end face of said shaft in axial direction of said shaft to said lateral recess, said clamping lever being disposed in said lateral recess formed in said shaft, and said tension rod being disposed in said bore formed in said shaft.

5. Sheet-guiding drum according to claim 4, wherein said one segment is formed with a radially inwardly extending flange having an inner side, said friction elements alternately connected to said segments and to said shaft have a mutually overlapping region, and said other end of said clamping lever is loosely disposed in said lateral recess, said clamping lever, in said mutually overlapping region, being active, by means of said radially outwardly directed end thereof, against said inner side of said flange, and including a counter-bearing disposed in a defining wall of said lateral recess on a side thereof located opposite from the friction surfaces of said friction elements, said counter-bearing being located at a shorter radial distance from said outwardly directed end of said clamping lever than from the other end thereof, said clamping lever being pivotable about said counter-bearing.

6. Sheet-guiding drum according to claim 5, wherein respective supporting surfaces for said clamping lever are formed of inserts of hardened material.

7. Sheet-guiding drum according to claim 5, wherein said one segment has an end face extending radially to the axis of said shaft, and a plurality of said friction elements and relatively thinner intermediate layers are secured to said end face of said one segment on the one hand, and a plurality of said friction elements complementary thereto are secured to a surface of said shaft extending radially to said shaft axis, on the other hand, said mutually overlapping region of said interengaging friction elements being disposed in a force flux of said two counterbearings for the clamping force.

8. Sheet-guiding drum according to claim 3 including a spring for biasing said tension rod in said axial clamping direction, and a manually operated actuating member disposed at an end face of said shaft and engageable with said tension rod for retracting said tension rod against the action of said spring, and an electrical circuit-breaking protection device couplable with said tension rod so as to displace said tension rod in axial direction only after transversing an axially effective idle path, for the purpose of tripping said protection device.

9. Sheet-guiding drum according to claim 8, including a substantially bell-shaped housing secured to said end face of said shaft, said spring biasing said tension rod in said clamping direction being braced, on the one hand, against said housing and, on the other hand, against said tension rod, said tension rod having a free end formed with a thread and extending axially displaceably outwardly through said housing, said actuating member being formed with an internal thread corresponding to said thread formed on said free end of said tension rod and being screwable thereon for axially displacing said tension rod over a first distance corresponding to said idle path, and over a second succeeding distance wherein said actuating member is braced against said housing.

10. Sheet-guiding drum according to claim 9, including stops for limiting end positions of said actuating member screwable on said tension rod and for simultaneously defining said idle path for tripping said electrical circuit-breaking protection device, one of said stops limiting turning of said actuating member and being movable by said tension rod, at the end of the axial displacement thereof, when said clamping device is released into operative position thereof.

11. Sheet-guiding drum according to claim 10, wherein said stops are active in radial direction and have a mutual axial overlap in said stop positions thereof which is smaller than the pitch of said thread with which said actuating member is screwable onto said tension rod.

12. Sheet-guiding drum according to claim 10, wherein said stops are formed by a cam on said actuating member, and two cams fixed against rotation and spaced from one another in the displacement direction of said tension rod a distance corresponding to the length of said idle path, said two cams fixed against rotation being axially displaceable.

13. Sheet-guiding drum according to claim 12, including a bolt extending through said substantially bell-shaped housing, said two axially displaceable cams being secured to an outer end of said bolt said bolt having an inner end braced axially against said tension rod under biasing action of a spring.

14. Sheet-guiding drum according to claim 13, including a structural unit disposed in said clamping device and comprising said substantially bell-shaped housing and said tension rod spring-biased in said clamping direction disposed in said housing, said actuating member and said stops associated therewith, and switching members for said electrical circuit-breaking protection device; and screw means for securing said structural unit to said end surface of said shaft.

15. Sheet-guiding drum according to claim 8, wherein said actuating member comprises a nut manually screwable on said thread of said tension rod.

* * * * *